US009928712B1

(12) United States Patent
Clark

(10) Patent No.: US 9,928,712 B1
(45) Date of Patent: Mar. 27, 2018

(54) SYSTEM AND METHOD FOR REMOTELY MONITORING A MEDICAL DEVICE

(71) Applicant: Frederick Huntington Firth Clark, New Fairfield, CT (US)

(72) Inventor: Frederick Huntington Firth Clark, New Fairfield, CT (US)

(73) Assignee: Frederick Huntington Firth Clark, New Fairfield, CT (US)

( * ) Notice: Subject to any disclaimer, the term of this patent is extended or adjusted under 35 U.S.C. 154(b) by 0 days.

(21) Appl. No.: 15/587,711

(22) Filed: May 5, 2017

(51) Int. Cl.
*G08B 29/00* (2006.01)
*G08B 21/02* (2006.01)
*G08B 29/04* (2006.01)

(52) U.S. Cl.
CPC ..... *G08B 21/02* (2013.01); *G08B 29/04* (2013.01)

(58) Field of Classification Search
CPC ..... G08B 21/02; G08B 29/04
See application file for complete search history.

(56) References Cited

U.S. PATENT DOCUMENTS

| | | | | |
|---|---|---|---|---|
| 5,319,355 | A | 6/1994 | Russek | |
| 5,331,549 | A | 7/1994 | Crawford, Jr. | |
| 6,364,834 | B1 | 4/2002 | Reuss et al. | |
| 6,406,426 | B1 | 6/2002 | Reuss et al. | |
| 7,390,299 | B2 | 6/2008 | Weiner et al. | |
| 7,724,147 | B2 | 5/2010 | Brown | |
| 7,749,164 | B2 | 7/2010 | Davis | |
| 8,273,018 | B1 | 9/2012 | Fackler et al. | |
| 8,756,078 | B2 | 6/2014 | Collins, Jr. et al. | |
| 9,142,117 | B2 | 9/2015 | Muhsin et al. | |
| 9,306,899 | B1 * | 4/2016 | Vendrow | H04L 51/34 |
| 9,411,934 | B2 | 8/2016 | Robinson et al. | |
| 9,517,034 | B2 | 12/2016 | Collins, Jr. et al. | |
| 9,801,541 | B2 * | 10/2017 | Mensinger | A61B 5/0004 |
| 2005/0185799 | A1 * | 8/2005 | Bertram | A61B 5/0002 381/67 |
| 2009/0099866 | A1 * | 4/2009 | Newman | G06F 19/327 705/2 |

(Continued)

FOREIGN PATENT DOCUMENTS

| | | | |
|---|---|---|---|
| JP | 2006095263 | A | 4/2006 |
| WO | 2016164268 | A1 | 10/2016 |

*Primary Examiner* — Joseph Feild
*Assistant Examiner* — Rufus Point
(74) *Attorney, Agent, or Firm* — Dilworth IP LLC

(57) ABSTRACT

A system and method for remotely monitoring a medical device includes a sensor for monitoring sounds in the proximity of a medical device. The sensor has a microphone for producing an audio supervision signal. There is a memory and processing circuit for storing the audio supervision signal and having a monitoring program that includes device alarm characteristics, and a status flag file, and a communication circuit for communicating with a server. There is a server in communication with the sensor and a remote terminal in communication with the server. The monitoring program is configured to analyze the audio supervision signal and to refresh the status flag file to a value based whether the audio supervision signal contains the device alarm characteristics. The server is configured to query the sensor and to send an alert to a remote terminal if the status flag signal indicates that the audio supervision signal matches the device alarm characteristics.

10 Claims, 2 Drawing Sheets

(56) References Cited

U.S. PATENT DOCUMENTS

| | | | | |
|---|---|---|---|---|
| 2011/0087079 | A1 | 4/2011 | Aarts | |
| 2012/0169467 | A1 | 7/2012 | Condra | |
| 2012/0302898 | A1* | 11/2012 | Zhang | A61B 5/0205 600/484 |
| 2013/0157571 | A1 | 6/2013 | Wondka et al. | |
| 2013/0197693 | A1* | 8/2013 | Kamen | G06F 19/3418 700/244 |
| 2013/0312066 | A1* | 11/2013 | Suarez | G06F 19/3418 726/4 |
| 2014/0125479 | A1 | 5/2014 | Schmidt | |
| 2014/0132413 | A1* | 5/2014 | Fox | A61B 5/0022 340/573.1 |
| 2014/0266713 | A1* | 9/2014 | Sehgal | G08B 23/00 340/540 |
| 2014/0275856 | A1 | 9/2014 | Kohlrausch et al. | |
| 2014/0379273 | A1* | 12/2014 | Petisce | G06F 19/345 702/19 |
| 2015/0065812 | A1 | 3/2015 | Pan | |
| 2015/0310865 | A1* | 10/2015 | Fay | G10L 15/22 704/254 |
| 2016/0056964 | A1* | 2/2016 | Andiappan | H04L 9/3263 713/189 |
| 2016/0086476 | A1 | 3/2016 | Mason et al. | |
| 2016/0283681 | A1* | 9/2016 | Falck | G06F 19/3406 |
| 2016/0300468 | A1* | 10/2016 | Stricker | G08B 21/02 |
| 2016/0321418 | A1* | 11/2016 | Reid | G06F 19/3406 |
| 2017/0076581 | A1* | 3/2017 | Felch | G08B 21/245 |
| 2017/0236404 | A1* | 8/2017 | Skolnik | G08B 25/14 340/539.17 |

* cited by examiner

SYSTEM AND METHOD FOR REMOTELY MONITORING A MEDICAL DEVICE

FIELD OF THE INVENTION

The present invention generally relates to the technical field of electronically monitoring medical devices, and more specifically relates to a system and method for monitoring a medical device designed to emit an audible alert signal in case of malfunction or a critical change in the condition of a patient.

BACKGROUND

In common medical care situations, medical devices which include electronic sensors are employed to that receive physiological data from patients. Such devices may be passive devices or active devices. Active devices, for example, may provide stimulus (e.g., cardiopulmonary resuscitation (CPR) machines), drugs, and/or oxygen.

In certain situations, a sensor not only provides status of physiological data and of the connected device, but may also provide alerts as to critical levels of a patient. For example, a blood pressure device may alert the medical professional as to a critically low blood pressure level and/or irregular heartbeat. In the case of an oxygen sensing device, the device may alert the professional as to low levels of oxygen to the patient. Such alerts may be triggered by abnormalities/conditions experienced by the patient and/or problems/malfunctions of the device. In such cases, the patient's well-being may depend on the intervention of a caregiver who is present at the time and in earshot of the alert from the device. If the caregiver is too far away to hear the alert, the patient's care may be compromised because the caregiver cannot respond.

Therefore, there is a need in the art for a system and method for alerting caregiver in remote locations that an audible alert is being issued from a medical device.

RELATED ART

United States Patent Publication US20160283681 ("Falck et al."). describes various pre-existing medical devices that emit signals to remote locations (see e.g., paragraphs 0005, 0065, 0072). The invention described by Falck et al. is a 'validation device' that may include (i) a microphone to detect an audio signal from a medical device, and (ii) an analyzer to identify the signal detected by the microphone. The validation device confirms issuance of the audio signal only back to the medical device (see, e.g., paragraph 0034), not to a remote location.

SUMMARY OF THE INVENTION

In one aspect, the present invention provides a sensor for monitoring a medical device. The sensor comprises a microphone for producing an audio supervision signal from an audible event detected by the microphone, a memory and processing circuit for storing the audio supervision signal and having a monitoring program that includes device alarm characteristics, and a status flag file, and a communication circuit for communicating with a remote device. The monitoring program is configured to analyze the audio supervision signal and to refresh the status flag file to a value based on whether the audio supervision signal contains the device alarm characteristics.

In one embodiment, the sensor may further comprise an alarm analysis program for identifying and storing device alarm characteristics from a sample device alarm.

In another aspect, the invention relates to a system for remotely monitoring a medical device, comprising a sensor for monitoring sounds in the proximity of a medical device, said sensor including a microphone for producing an audio supervision signal from an audible event detected by the microphone, a memory and processing circuit for storing the audio supervision signal and having a monitoring program that includes device alarm characteristics, and a status flag file, and a communication circuit for communicating with a server. There is a server in communication with the sensor and a remote terminal in communication with the server. The monitoring program is configured to analyze the audio supervision signal and to refresh the status flag file to a value based whether the audio supervision signal contains the device alarm characteristics. The server is configured to query the sensor and to send an alert to a remote terminal if the status flag signal indicates that the audio supervision signal matches the device alarm characteristics.

In one embodiment, the remote terminal is any one of a video display terminal, mobile phone, tablet, laptop, personal computer, an audio speaker or a pager.

In yet another embodiment, the sensor is configured to be connected to a device status signal port of a medical device configured to issue a device status signal via the device status signal port to indicate when the medical device is not functioning properly and the sensor is configured to issue a status flag that indicates failure when the medical device status signal does not indicate that the medical device is functioning properly.

Optionally the device alarm characteristics comprise frequency and amplitude. In certain embodiments, the device alarm characteristics include duration of the frequency and amplitude.

In a particular embodiment, the memory and processing circuit includes an alarm analysis program for identifying device alarm characteristics.

In another aspect, the invention relates to a method for remotely monitoring a medical device. The method comprises providing at least one sensor including a microphone, a memory and processing circuit having a status flag file stored therein, a signal analyzer, an alarm analysis program for identifying device alarm characteristics and for generating a monitoring program which can generate status flag files, and a communication circuit for communicating with a server; analyzing a device alarm to identify device alarm characteristics; generating a monitoring program to identify device alarm characteristics in an audio supervision signal; sensing audible events from the vicinity of a medical device through the microphone and producing the audio supervision signal; testing the audio supervision signal for device alarm characteristics and generating a status flag signal indicating the result of the test, wherein a PASS status flag signal indicates that the audio supervision signal does not have the device alarm characteristics and a FAIL status flag signal indicates that the audio supervision signal does have the device alarm characteristics; querying the sensor from a remote server to ascertain that value of the status flag file, and sending an alert if the status flag value is FAIL.

DETAILED DESCRIPTION

A description of embodiments of the present invention will now be given with reference to the Figures. It is expected that the present invention may be embodied in other specific forms without departing from its spirit or essential characteristics. The described embodiments are to be considered in all respects only as illustrative and not restrictive except where the description expressly states that a particular feature or limitation is needed in all embodiments.

Figure 1A:
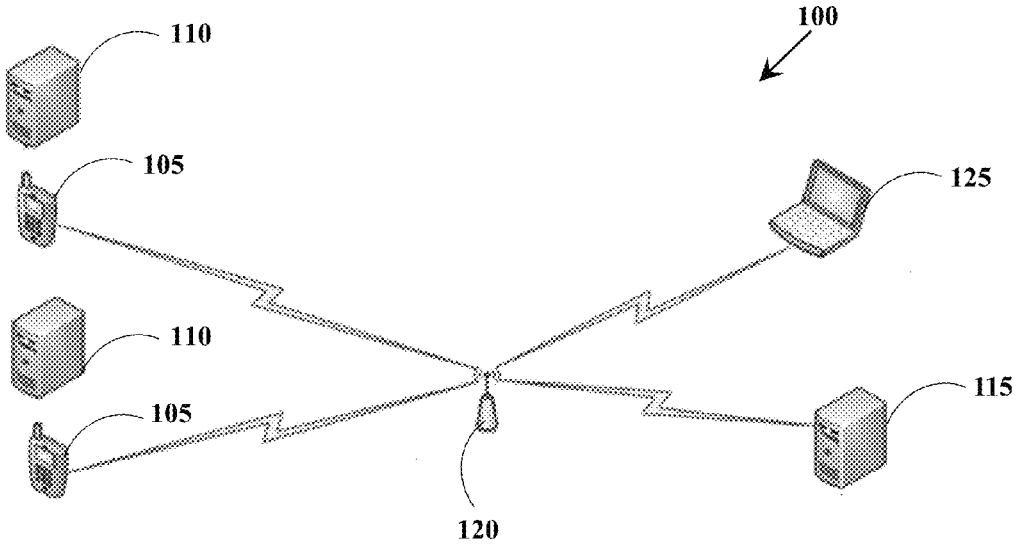
FIG. 1A is schematic representation of a system for remotely monitoring a medical device according to one embodiment of the present invention.

FIG. 1 is a schematic representation of the components of a system 100 with which various embodiments of the present invention may be implemented. The system 100 includes at least one sensor 105 situated near a prior art medical device 110 which is configured to emit an audible signal in case of malfunction or upon sensing a critical condition of the patient (a local "device alarm"). The conventional medical device 110 may be a blood pressure monitor, assisted breathing device, EKG monitor, ECG monitor, etc. If the medical device 110 is mounted on a stand, the at least one sensor 105 might also be mounted on the stand, directly above or below the medical device 110 to ensure that the device alarm is captured if it is sounded. There is a server 115 (e.g., a local Apache server) in communication with the sensor 105 via a wireless network provided by a wireless module 120, and a remote terminal 125 with which the server can communicate via the wireless network or otherwise. The remote terminal 125 may be any remotely accessible I/O device to which a caregiver is able to respond to, e.g., a video display, a mobile phone, tablet, laptop, personal computer, an audio speaker or a pager.

Figure 1B:
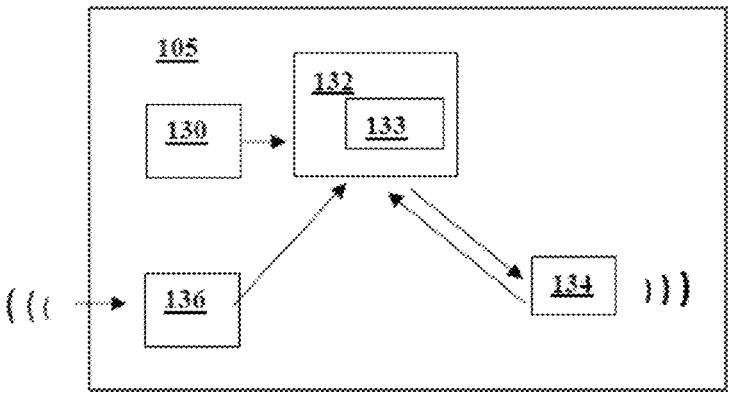
FIG. 1B is a schematic representation of a sensor used in a system according to a particular aspect and embodiment of the invention.

As indicated in FIG. 1B, the sensor 105 is an electronic device which includes an acoustic microphone 130 for sensing audible sounds ("audible events") in the vicinity of the medical device 110, possibly including the device alarm, and generating an audio supervision signal therefrom. The sensor 105 also includes a memory and processing circuit 132 for recording the audio supervision signal, optionally with a time stamp associated with the recording, and a communication circuit 134 for communication with a server via a network, e.g., via the wireless network provided by a wireless module 120.

The memory and processing circuit 132 is programmed with an alarm analysis program which can analyze a device alarm to determine its characteristics, and generate a monitoring program to identify the device alarm. Before the sensor 105 is placed in service, the medical device 110 is registered with the sensor by running the alarm analysis program on a sample recording of the device alarm to identify at least one distinctive characteristic of the device alarm, such as the loudest frequency component of the device alarm. This enables the sensor 105 to "learn" the device alarm characteristics. For example, in one embodiment, the alarm analysis program is designed to record a sample of the medical device alarm (which can typically be sounded on demand as a test feature of most medical devices), analyze the sample and create a report of frequencies in the sample, and their amplitudes. The program identifies device alarm characteristics from the sample, by which other sound signals can be assessed to determine if those signals are device alarms. In one embodiment, the alarm analysis program identifies the frequency having the highest average amplitude over an 8-second sample, and this frequency is recorded as the target frequency as a device alarm characteristic for identifying alarm signals from that device. The alarm analysis program then generates a monitoring program which is deployed to the sensor. The device alarm characteristics, e.g., the target frequency determined by the alarm analysis program, is incorporated as a parameter into the monitoring program. When the sensor is in service, the monitoring program then analyzes samples from the audio supervision signal on regular intervals (e.g., 8 second passes) and determines whether the audio supervision signal is from a device alarm. In one embodiment, the monitoring program analyzes the amplitudes of the frequency components of the audio supervision, and if it contains the target frequency at an amplitude above speaking volume during a suitable interval, e.g., 8 seconds, the audio supervision signal is identified as a device alarm.

Generally, medical devices have device alarms that are all at different frequencies, and in some cases the device alarms comprise combinations of tones, so that it is possible to accurately distinguish a device alarm from a particular medical device from other ambient sounds, and even to distinguish the device alarm from one medical device from the device alarm of another medical device.

The sensor also runs an instance of a program in the memory and processing circuit 132 (a "network server instance 133") which stores and refreshes (e.g., updates) a device status file. The value of the device status file reflects the status of the medical device 110 and is sometimes referred to herein as a "status flag." Optionally, the device status file includes a time stamp value to record when the value of the status flag was most recently refreshed.

The monitoring program is designed so that when the frequency and amplitude thresholds of the device alarm (as determined by the alarm analysis program) are met by the audio supervision signal, i.e., when the audible event is identified as a device alarm, the monitoring program can change the status flag in the network server instance in the sensor 105 to a value that indicates that there is reason for alarm and a need for a caregiver to attend to the medical device 110 and/or to the patient; such a status flag is referred to herein as a "FAIL" status flag. When the monitoring program indicates that the audio supervision signal does not meet the frequency and amplitude thresholds of the device alarm, the monitoring program can change the status flag to a value indicating that there is no reason for alarm and no need for a caregiver to attend to the medical device 110 and/or the patient; such a signal is referred to herein as a "PASS" status flag.

In one embodiment, the medical device 110 includes a device status signal port (not shown) configured to emit an electronic device status signal, and there is a connection between the device's status signal port and the sensor 105 at an input jack 105*e*. The memory and processing circuit 132 is configured to analyze the electronic device status signal periodically and generate a status flag value therefrom. However, the invention is not limited in this regard and in other embodiments the monitor device 105 does not include an input jack.

The server 115 is programmed to run a sensor query instance to query the sensor 105 on an ongoing basis, e.g., 6 times per second, and to run a report routine which is responsive to the value of the status flag. Changes in the status flag from the sensor 105 to a FAIL status flag are communicated to caregivers in at least one way, optionally multiple ways, convenient for the caregivers, e.g., by creating a message on a display, by sending a signal to a pager or sending a text message to a smart phone, etc. In one embodiment, the server conveys the value of the status flag to at least one remote terminal 125 of a personnel or caregiver in real time through the at least one wired or wireless module 120, at least when the status flag value is FAIL, but optionally also when the value is PASS. In one embodiment, if a FAIL status flag is detected, the sensor and the server continue to send alerts while the medical device until the alarm is cleared by a system user. The sensor then re-sets the status flag to a "PASS" state, and the server getting the "PASS" value back from the on the sensor returns the status to "PASS" for that sensor on the monitoring system.

The server 115 may be programmed so that if the sensor 105 does not respond to the query from the server, the server sets the value of the status flag to DOWN.

Optionally, in an embodiment in which the status of a sensor 105 is displayed continuously in a visual manner, the server 115 may be programmed to allow the system user to set the status flag for a sensor to DISABLED when the system user no longer sees a need to respond to the sensor. The sensor query instance may continue to query a DISABLED sensor and display and/or respond to a PASS or FAIL status flag, but may do so in a manner that also conveys the DISABLED status, e.g., the sensor and its status may be listed on a screen, but could be greyed out, while other sensors that require the attention of caregivers are displayed in an alternative color.

Optionally, the remote terminal 125 may be configured to provide multiple modes of alert, e.g., graphical, visual and auditory, and the server may be configured to activate multiple modes of alert to the caregiver according to the configuration of the display available to the caregiver.

In another aspect, the system 100 can monitor more than one sensor. The system may check for a unique index file on the network server instance on each sensor, based on which the server can monitor and display status flag of each sensor in real time. For example, each sensor may be configured by name on the server based on the sensor's IP address, e.g., IP address may be 10.1.1.2 is assigned to sensor "A", and then the system operator names sensor A for the room where it is deployed on the monitoring console, or for the patient that the sensor is monitoring.

In another aspect, a sensor 105 can monitor more than one medical device 110. The alarm analysis program is configured to produce a monitoring program with amplitude and frequency parameters for multiple medical device alarms, and the sensor is programmed to run a server instance for each medical device, or to store a status flag in a network address that is specifically assigned to a particular medical device and which can be specifically queried by the server. The system is configured so that the server 115 on running a process adds on each device to the server 115. When the process is on, it prompts for each medical device 110 to be monitored on that sensor 105. The system is further configured with a process to add additional medical devices 110 for that sensor 105. Additionally, each instance can be disabled on the server 115 if a device is no longer being monitored by that sensor 105. In a particular embodiment, the system is configured such that the caregiver is able to track the respective medical devices 110.

Figure 2:
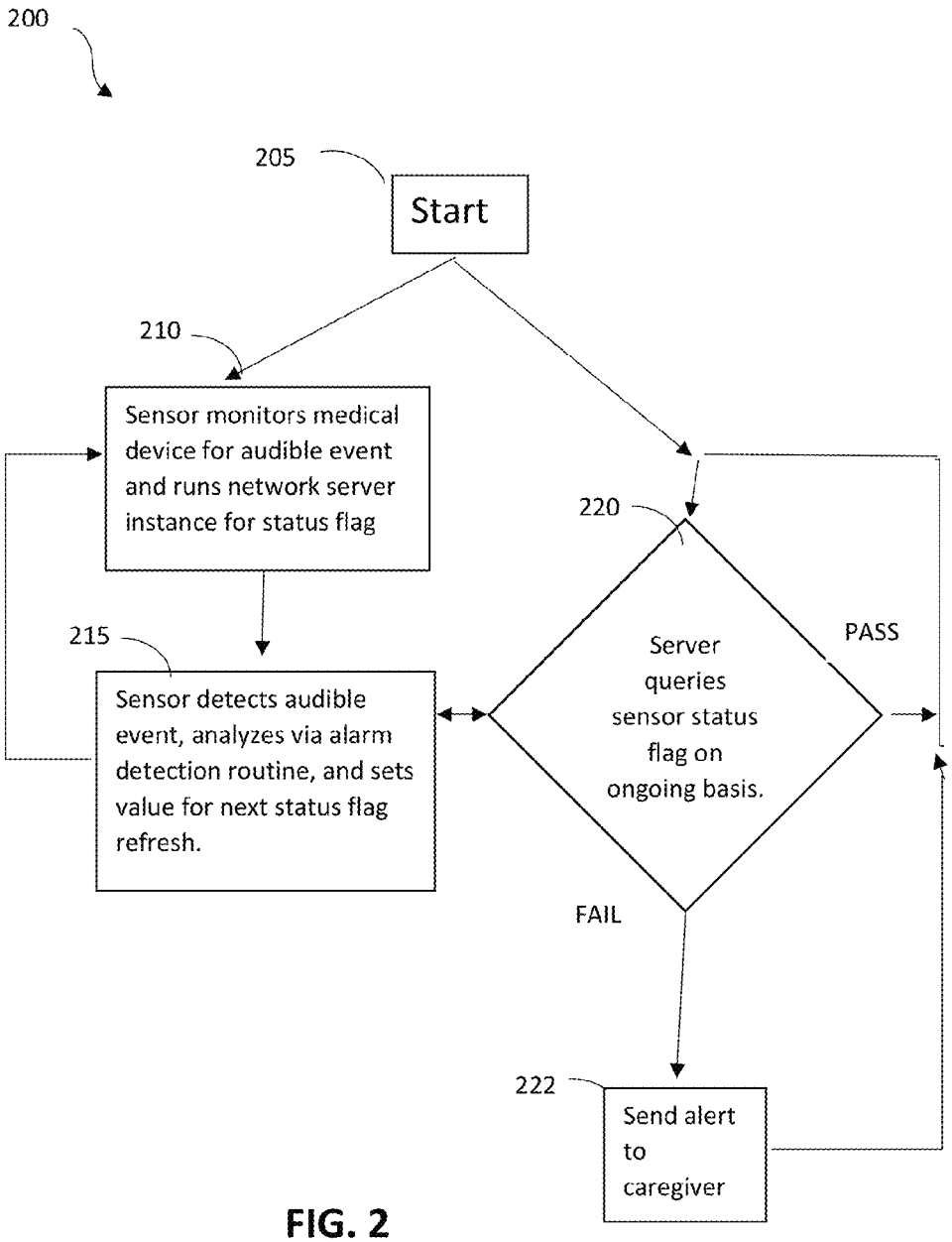
FIG. 2 is a flow chart of a method for remotely monitoring the function of a medical device, according to another embodiment of the present invention.

FIG. 2 is a flow chart of a method for remotely monitoring the function of a medical device. The method is implemented by use of system 100, after the sensor learns the device alarm as previously described.

At step 210, audible events such as sound signals are monitored from the medical device by a sensor 105 while the sensor runs a network server instance to maintain the status flag.

At step 215, the microphone 130 detects audible events from the vicinity of the medical device 110, and the monitoring program analyzes the resulting audio supervision signal and sets the status flag of the network server instance accordingly. If the audio supervision signal is identified as a device alarm, the network server instance 133 sets the flag value to FAIL. The sensor continues to monitor and analyze audible events around the sensor and update the status flag.

Meanwhile, the server 125 runs the sensor query instance 220, by which the server 115 queries the sensor 105 to obtain the value of the status flag. If the status is FAIL, the server proceeds to step 222, issuing an alert. Otherwise, if the status flag value is PASS, the server need only wait until the next scheduled query.

In one embodiment, upon receiving a FAIL status flag value from the sensor 105 from the sensor query instance, the server switches the text in an index file in the server to a FAIL index file, and the server report routine is programmed to respond to the FAIL index file to report an alarm state, e.g., the server issues an alert to a remote terminal 125. Optionally, the report routine reports a DOWN flag status in the same way, but indicating that the sensor is DOWN rather than FAIL.

The status flag for a medical device, and/or changes in the status flag, and particularly a change to a FAIL state, may be alerted in various ways. In one embodiment, a change in the status flag for the medical device is alerted through a display device connected to the server, e.g., a video monitor, in real time. If the medical device is in normal condition, the status flag is a PASS flag. In another embodiment, a change in the status flag is alerted through a portable device (cell phone, pager, etc.) that can be carried by a personnel or caregiver. The server runs a communication program which is able to contact a caregiver when the flag changes from PASS to FAIL, by sending a text message to a portable device of the caregiver, as an alert that attention is needed. Once the alarm is resolved, the monitor device 105 is reset and the server will detect that there is no longer an issue on the next signal cycle and the index file will be returned to PASS. In an optional embodiment, the server can also send an "all clear" text message or pager signal when the flag changes from FAIL to PASS.

The foregoing examples show the use of a single monitor device 105 that monitors a single medical device 110, but the invention is not limited in this regard and in other embodiments, a monitor device may be configured to monitor more than one medical device. For example, since different medical devices have different alarm tones, a sensor according to another embodiment is configured to store alarm reference files for a plurality of medical devices, and the signal analyzer may compare an audio supervision signal to each of the stored alarm reference files and to generate a FAIL signal if the audio supervision signal corresponds to any of the alarm reference files. This embodiment allows the sensor 105 to monitor more than one medical device simultaneously, and issue a FAIL signal if any of the medical devices fails. This will be useful if a patient is being assisted by more than one medical device, or if a single sensor is place in a room shared by multiple patients, each using a different medical device. Optionally, there is a process on the monitor or server which is run to add each medical device to the server. When this process is run it prompts for the status signal for each medical device being monitored by the monitor device. There may also be a process to add additional medical devices for that monitor device. Additionally, each instance can be disabled on the server if a device is no longer being monitored by the monitor device.

As previously described, the server sends an alert to a remote terminal following receipt of a FAIL status flag signal. However, the invention is not limited in this regard and in other embodiments, the remote terminal may be configured to query the server. For this purpose, the server maintains a unique index file for each monitor device in the system. For example, if there are three monitor devices working in room #1, each reporting the status of a different medical device, e.g., one on an IV, one on a CV, one on an EKG, the server could have 3 files, one for each device, and the remote terminal could be programmed to check on the web instance based on devices, e.g., index-iv.html, index-cv.html, etc. Based on the response for each of these the remote terminal can display something like "room 1 iv PASS" "room 1 cv FAIL," etc.

In another embodiment, the memory file for alarm sounds and the sound analyzer are stored on the server and the display device provides audio from the patient's room, and the display device sends audio signals to the server, so that the server can analyze the sound in the room and change the flag from PASS to FAIL when it detects an alarm signal, or when the audio feed from the monitor has stopped unexpectedly.

In another embodiment, the medical device has a device status signal output port through which it emits signals that indicate the operating status of the medical device, i.e., whether it is operating normally or is in an error state. The monitor device 105 may then be connected to the device and may be configured to translate the device status signal to the appropriate Flag for the server.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A sensor for monitoring a medical device, comprising:

a microphone for producing an audio supervision signal from an audible event detected by the microphone, a memory and processing circuit for storing the audio supervision signal and having a monitoring program that includes device alarm characteristics, and a status flag file, and a communication circuit for communicating with a server;

wherein the monitoring program is configured to analyze the audio supervision signal and to refresh the status flag file to a value based on whether the audio supervision signal contains the device alarm characteristics; and wherein the server is configured to query the sensor and to send an alert to a remote terminal if the status flag signal indicates that the audio supervision signal matches the device alarm characteristics.

2. The sensor of claim 1 further comprising an alarm analysis program for identifying and storing device alarm characteristics from a sample device alarm.

3. A system for remotely monitoring a medical device, comprising:

a sensor for monitoring sounds in the proximity of a medical device, said sensor including a microphone for producing an audio supervision signal from an audible event detected by the microphone, a memory and processing circuit for storing the audio supervision signal and having a monitoring program that includes device alarm characteristics, and a status flag file, and a communication circuit for communicating with a server; a server in communication with the sensor; and a remote terminal in communication with the server;

wherein the monitoring program is configured to analyze the audio supervision signal and to refresh the status flag file to a value based on whether the audio supervision signal contains the device alarm characteristics; and wherein the server is configured to query the sensor and to send an alert to a remote terminal if the status flag signal indicates that the audio supervision signal matches the device alarm characteristics.

4. The system of claim 3, wherein the remote terminal is any one of a mobile phone, tablet, laptop, personal computer, an audio speaker or a pager.

5. The system of claim 3, wherein the sensor is configured to be connected to a device status signal port of a medical device configured to issue a device status signal via the device status signal port to indicate when the medical device is not functioning properly and the sensor is configured to issue a status flag that indicates failure when the medical device status signal does not indicate that the medical device is functioning properly.

6. The system of claim 3 wherein the device alarm characteristics comprise a frequency and an amplitude.

7. The system of claim 6 wherein the device alarm characteristics include a duration of the frequency and amplitude.

8. The system of claim 3 wherein the memory and processing circuit further includes an alarm analysis program for identifying device alarm characteristics.

9. A method for remotely monitoring a medical device, the method comprising:

providing at least one sensor including a microphone, a memory and processing circuit having a status flag file stored therein, a signal analyzer, an alarm analysis program for identifying device alarm characteristics and for generating a monitoring program which can generate status flag files, and a communication circuit for communicating with a server;

analyzing a device alarm to identify device alarm characteristics;

generating a monitoring program to identify device alarm characteristics in an audio supervision signal;

sensing audible events from the vicinity of a medical device through the microphone and producing the audio supervision signal;

testing the audio supervision signal for device alarm characteristics and generating a status flag signal indicating the result of the test, wherein a PASS status flag signal indicates that the audio supervision signal does not have the device alarm characteristics and a FAIL status flag signal indicates that the audio supervision signal does have the device alarm characteristics;

querying the sensor from a remote server to ascertain that value of the status flag file, and sending an alert if the status flag value is FAIL.

10. The method of claim 9, wherein the device alarm characteristics comprises a frequency and amplitude over a specified sample period.

* * * * *